US009982574B2

(12) United States Patent
Weber

(10) Patent No.: US 9,982,574 B2
(45) Date of Patent: May 29, 2018

(54) CONNECTION CONCEPT OF A MULTIPART ROTOR FOR A HYDRAULIC CAMSHAFT ADJUSTER

(71) Applicant: Schaeffler Technologies AG & Co. KG, Herzogenaurach (DE)

(72) Inventor: Juergen Weber, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 1 day.

(21) Appl. No.: 15/039,216

(22) PCT Filed: Oct. 22, 2014

(86) PCT No.: PCT/DE2014/200582

§ 371 (c)(1),
(2) Date: May 25, 2016

(87) PCT Pub. No.: WO2015/090295

PCT Pub. Date: Jun. 25, 2015

(65) Prior Publication Data

US 2017/0037746 A1 Feb. 9, 2017

(30) Foreign Application Priority Data

Dec. 18, 2013 (DE) ..... 10 2013 226 454

(51) Int. Cl.
*F01L 1/46* (2006.01)
*F01L 1/344* (2006.01)

(52) U.S. Cl.
CPC ..... *F01L 1/3442* (2013.01); *F01L 2001/3445* (2013.01); *F01L 2001/34423* (2013.01); *F01L 2101/00* (2013.01); *F01L 2101/02* (2013.01); *F01L 2103/00* (2013.01)

(58) Field of Classification Search
CPC ..... F01L 2001/34423; F01L 2001/3445
USPC ..... 123/90.17
See application file for complete search history.

(56) References Cited

U.S. PATENT DOCUMENTS

| | | | |
|---|---|---|---|
| 7,640,902 | B2 | 1/2010 | Knecht et al. |
| 8,490,589 | B2 | 7/2013 | Arnold |
| 8,550,046 | B2 | 10/2013 | Terfloth et al. |
| 8,578,899 | B2 | 11/2013 | Ottersbach et al. |

(Continued)

FOREIGN PATENT DOCUMENTS

| | | |
|---|---|---|
| DE | 19856318 | 6/2000 |
| DE | 10 2008 028 640 A1 | 12/2009 |

(Continued)

*Primary Examiner* — Jorge Leon, Jr.
(74) *Attorney, Agent, or Firm* — Davidson, Davidson & Kappel, LLC

(57) ABSTRACT

A multipart rotor (1) for a hydraulic camshaft adjuster, including a rotor main body (2) which is connected to a first rotor auxiliary body (3) for conjoint rotation and in an axially fixed manner, the rotor main body (2) and the first rotor auxiliary body (3) together forming at least one hydraulic medium guide channel (5). A second ring-shaped rotor auxiliary body (4) is arranged concentric to the rotor main body (2) and the first rotor auxiliary body (3) on the radially inner side of both components, the second rotor auxiliary body (4) being fastened to the rotor main body (2) and/or to the first rotor auxiliary body (3) for conjoint rotation and in an axially fixed manner.

11 Claims, 4 Drawing Sheets

(56) References Cited

U.S. PATENT DOCUMENTS

| | | | | |
|---|---|---|---|---|
| 8,857,390 | B2 * | 10/2014 | Malen | B22F 5/008 123/90.15 |
| 8,931,448 | B2 | 1/2015 | Schelter | |
| 9,284,862 | B2 | 3/2016 | Frey | |
| 2006/0137635 | A1 * | 6/2006 | Hayashi | F01L 1/022 123/90.17 |
| 2006/0278189 | A1 * | 12/2006 | Knecht | F01L 1/3442 123/90.17 |
| 2011/0126785 | A1 * | 6/2011 | Terfloth | F01L 1/022 123/90.15 |
| 2013/0199479 | A1 * | 8/2013 | Ottersbach | F01L 1/3442 123/90.17 |
| 2013/0247855 | A1 * | 9/2013 | Adachi | F01L 1/3442 123/90.15 |
| 2014/0238325 | A1 * | 8/2014 | Frey | F01L 1/3442 123/90.17 |

FOREIGN PATENT DOCUMENTS

| | | | |
|---|---|---|---|
| DE | 10 2009 031 934 | A1 | 1/2011 |
| DE | 10 2009 053 600 | | 5/2011 |
| DE | 10 2011 117 856 | A1 | 5/2013 |
| DE | 102012200756 | A1 | 7/2013 |
| EP | 1696107 | | 8/2006 |
| EP | 1 731 722 | A1 | 12/2006 |
| WO | WO 2009/152987 | A1 | 12/2009 |
| WO | WO 2010/128976 | A1 | 11/2010 |

* cited by examiner

CONNECTION CONCEPT OF A MULTIPART ROTOR FOR A HYDRAULIC CAMSHAFT ADJUSTER

The present invention relates to a multipart rotor, for example a two- or three-part rotor, for a hydraulic camshaft adjuster, which includes a rotor main body that is connected to a first rotor secondary body in a rotatably fixed and axially fixed manner, the rotor main body and the first rotor secondary body together forming at least one hydraulic medium-conducting channel, and a second, ring-shaped rotor secondary body being situated concentrically with respect to the rotor main body and the first rotor secondary body on the radially inner side of the two components.

The rotor main body could also be referred to as a central body or cup-shaped body. The hydraulic medium-conducting channel could also be referred to as an oil channel when pressure oil/oil is used as the hydraulic medium.

BACKGROUND

Multipart rotors for hydraulic camshaft adjusters of the vane cell type are already known from the prior art. Thus, for example, rotor halves are joined with pins and/or sintered. It is known to mount two plastic rotor parts on a steel support, and to additionally glue two rotor parts which are joined thereto. In addition, rotor parts may ensure a connection by nested geometries that are adapted to one another. Furthermore, it is possible to provide two rotor halves which seal off oil channels via sintered facets. It is also known to design the rotor as a composite system in which a rotor core in addition to a cover forms oil channels. The use of a form fit and a press fit in oil channels is likewise known in principle.

Thus, for example, DE 10 2009 031 934 A1 provides a camshaft adjuster which includes a stator and a rotor, situated in the stator, which includes vanes, each of which is situated in a chamber formed between the stator and the rotor, the vanes dividing their respective chamber into two subchambers, and pressure oil being suppliable to and dischargeable from each subchamber via oil channels, so that the pressure oil may exert a torque on the rotor. Due to this configuration, the rotor is rotatable and adjustable for the camshaft adjustment, the rotor being made of a metallic base structure which includes a plastic liner, axially adjacent thereto, in which at least one of the oil channels is formed.

A two-part rotor is also known from WO 2010/128976 A1 which includes a sleeve part that is concentric with respect to a main body which forms a vane, the hydraulic medium-conducting channels formed as oil channels being present in the sleeve part.

Another hydraulic camshaft adjuster is known from DE 10 2008 028 640 A1. The cited publication describes a hydraulic camshaft adjuster which includes a drivable outer body having at least one hydraulic chamber, and an inner body which is situated internally with respect to the outer body and fixedly connectable to a camshaft, and which includes at least one swivel vane which extends radially into the hydraulic chamber, thus dividing the hydraulic chamber into a first and a second working chamber. The inner body also includes at least one oil supply line and one oil discharge line which extend from a casing interior to a casing exterior of the inner body, up to one of the two working chambers. The inner body is made up of at least one first element and one second element, each of the two elements at mutually facing front sides having a geometry which, together with the respective other element, forms the oil supply line and the oil discharge line of the inner part.

A multipart joined rotor for hydraulic camshaft adjusters having joint sealing profiles is also known from DE 10 2011 117 856 A1. The described camshaft adjusting device for internal combustion engines and a method for manufacturing same relate to a stator wheel and a rotor wheel which cooperates with the stator wheel. The stator wheel is driven in rotation about a rotation axis, the rotor wheel being connectable to a camshaft of the internal combustion engine, and in addition the stator wheel including radially inwardly facing stator vanes, between which radially outwardly facing rotor vanes (which define the vane cells) situated on the rotor wheel extend, so that fluid chambers/working chambers A and B are formed between the stator vanes and the rotor vanes, and which may be acted on with a pressure fluid via fluid channels, the rotor wheel including a first partial body and a second partial body, a joining surface of the first partial body and a joining surface of the second partial body being joined together, and depressions being introduced into at least one of the two joining surfaces in order to form the fluid channels, at least at spaced intervals. To provide a camshaft adjusting device which includes a rotor wheel that is formed from two partial bodies which are joined together, in the cited publication it is provided that the fluid channels are sealed off, and that a defined contact of the brought-together joining surfaces is created.

A camshaft adjuster which operates according to the swivel motor principle, which means that it is able to move back and forth at a certain angle, generally includes a stator and a rotor, as also provided in EP 1 731 722 A1, for example. The rotor itself is provided as a composite system made up of at least two components. One of the components is a cover. The other component of the composite system may be referred to as a rotor core. The cover is placed on the rotor.

Another hydraulic camshaft adjuster is known from WO 2009/1252987 A1.

The rotor in DE 10 2009 053 600 A1 has also proven to be easy to manufacture and robust under load. The cited publication provides a rotor, in particular for a camshaft adjuster, which includes a rotor base body having a hub part with a central oil supply line. At least one vane which is radially situated in the hub part, and an oil channel which extends through the hub part on both sides of a vane and which is fluidically connected to the central oil supply line, is provided in the hub part. The manufacture of the rotor base body is greatly simplified by dividing the rotor base body along a parting line so that it is made up of two base body parts. Journals or pins are inserted for joining the two rotor halves together. The journals are provided at one of the two rotor halves, and engage with recesses in the other rotor half.

SUMMARY OF THE INVENTION

However, the previous approaches have disadvantages with regard to costs, for example due to the provision of connecting pins or the need for keeping adhesives on hand which are additionally or exclusively used. In addition, hazardous materials are frequently involved which should be avoided. Furthermore, the connection obtained is often not robust enough for the requirements of the customer. In addition, when longitudinal press fits, heretofore common at certain locations, are used, component deformations occur which should be avoided. Also, there is always a risk of the rotor jamming in the stator. The previous approaches are also not sufficiently secured against leaks. Furthermore, cracks or other component damage may occur during operation which result(s) in failure of the hydraulic camshaft adjuster.

An object of the present invention is to eliminate or at least minimize the stated disadvantages. In particular, the aim is to provide a rotor variant that is cost-effective and easy to manufacture, and also particularly long-lasting.

For a generic rotor the present invention provides that the second rotor secondary body is secured to the rotor main body and/or to the first rotor secondary body in an axially fixed and rotatably fixed manner.

It is advantageous when a press fit, for example a longitudinal press fit, and/or caulking is/are used for the axially fixed and rotatably fixed securing. The hydraulic medium flow, i.e., the oil flow within the rotor, in particular at the radially inner side of the rotor main body and of the first rotor secondary body, is controlled in this way.

One advantageous exemplary embodiment is characterized in that the second rotor secondary body is designed as an oil line/oil-conducting ring in such a way that it conducts oil that is supplied axially from two sides of the oil-conducting ring to different hydraulic medium-conducting channels (A and B), or is returnable into the oil return line (for example, during venting of a locking borehole or of a C channel in the case of center locking), the oil from one side of the oil-conducting ring being supplied only to one hydraulic medium-conducting channel (A), and the oil from the other side of the oil-conducting ring being supplied only to the other hydraulic medium-conducting channel (B). A particularly compact rotor design is made possible in this way.

It is advantageous when the one hydraulic medium-conducting channel and the other hydraulic medium-conducting channel for filling different working chambers (A or B) of a vane cell extend in a shared separating plane which is oriented perpendicularly with respect to the axial direction and defined by the abutment of the end faces of the rotor main body and of the first rotor secondary body. Multiple hydraulic medium-conducting channels may fill various identical working chambers, i.e., working chambers A or working chambers B. Efficient functioning of the rotor even under high loads is thus ensured.

It is advantageous when the oil-conducting ring includes oil-conducting pockets which are open in opposite (axial) directions, and which are advantageously distributed over the circumference of the oil-conducting ring and which alternate in contact with one another.

In addition, it is advantageous when the group made up of the rotor main body, the first rotor secondary body, and the second rotor secondary body includes different materials or has different densities, hardnesses, and/or porosities. Furthermore, it is possible for the particular component to be compacted only on the outer surface, based on a calibration process, in such a way that little or no porosity is present in a delimited layer, and the hardness is increased.

In another advantageous exemplary embodiment, it has been found to be particularly advantageous when the material is a metallic and/or ceramic sintered material. In addition, a plastic, a steel alloy, or a light alloy that is pure or permeated with sintered material may be used as the material.

To increase the load-bearing capacity, it is advantageous when all or at least two components of the group made up of the rotor main body, first rotor secondary body, and second rotor secondary body are pinned together, the pins advantageously being oriented in the axial direction and being shorter than the overall rotor width measured in the axial direction, or being longer, in which case they are used as spring suspension pins.

Three of the pins used for the pinning are advantageously utilized as spring suspension pins, and protrude beyond the same end face of the rotor main body, on the side facing away from the second rotor secondary body.

A rotor variant which is particularly robust under load and quickly installable may be achieved when the rotor main body or the first rotor secondary body has integral projections and recesses which engage with one another in a form-fit and/or force-fit manner.

It is advantageous when the second rotor secondary body includes an anti-twist section, for example in the manner of a radially outwardly facing elevation or a radially outwardly facing depression, which cooperates with a corresponding anti-twist counter section for preventing twisting of the second rotor secondary body relative to the rotor main body or the first rotor secondary body.

One advantageous exemplary embodiment is characterized in that two anti-twist sections are formed on exactly opposite sides of the second rotor secondary body, namely, on a radially outer side/at the outer circumference, and offset by exactly 180° or less than 180°, for example 110° or 120°.

One advantageous exemplary embodiment is characterized in that the anti-twist section adjoins an end face of the second rotor secondary body.

BRIEF DESCRIPTION OF THE DRAWINGS

The present invention is also explained in greater detail below with the aid of the drawings, which illustrate a certain number of exemplary embodiments in variants.

DETAILED DESCRIPTION

Figure 1:
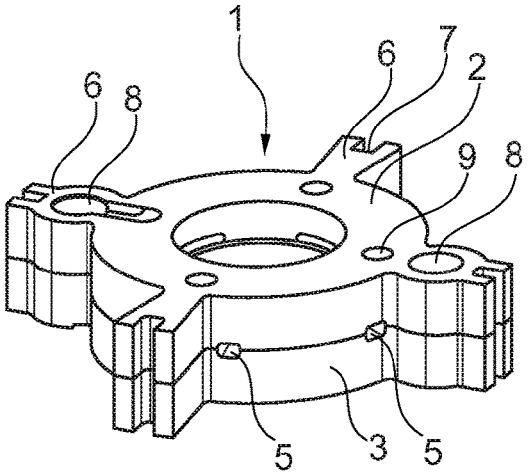
FIG. 1 shows a perspective view of a first multipart rotor according to the present invention according to a first specific embodiment, using a longitudinal press fit between the second rotor secondary body and at least one of the following components: rotor main body and first rotor secondary body.

The figures are merely schematic, and are used only for an understanding of the present invention. Identical elements are provided with the same reference numerals. Features of one exemplary embodiment may also be transferred to another exemplary embodiment, i.e., are interchangeable.

Figure 2:
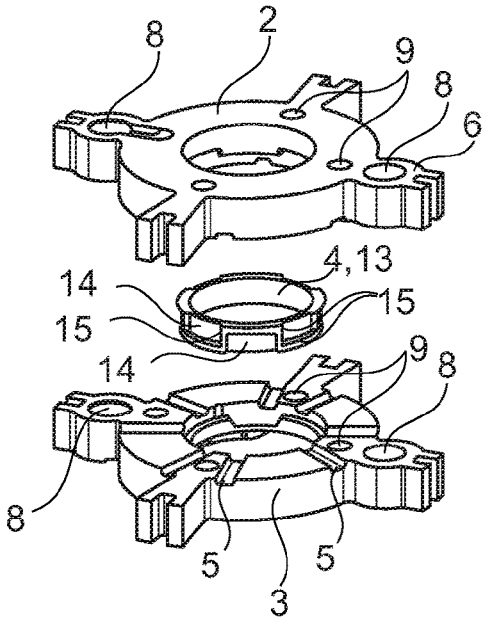
FIG. 2 shows an exploded view of the rotor from FIG. 1.

FIG. 1 illustrates a multipart rotor 1 which is provided for use in a hydraulic camshaft adjuster of an internal combustion engine. The rotor includes a rotor main body 2 and a first rotor secondary body 3. In addition, a second rotor secondary body 4 is inserted, as is particularly clearly apparent in FIGS. 2 through 4.

Rotor main body 2 and first rotor secondary body 3 are contoured in such a way that they form hydraulic medium-conducting channels 5 when their mutually facing front sides come into contact with one another. Hydraulic medium-conducting channels 5 are provided for supplying and/or discharging hydraulic medium, such as oil, to or from working chambers A and B of a vane cell. A vane cell is defined by rotor 1 and a stator, not illustrated, between two vanes 6. The vane cell is divided into working chambers A and B by a radially inwardly protruding projection.

Grooves 7 may be provided at the radially protruding end of vanes 6; sealants such as elastic membranes are insertable into the grooves. Holes oriented in the axial direction are provided in at least one of vanes 6, but in the present case, in two vanes 6, for accommodating one locking pin or two locking pins. Fixing holes 9 are also present into which the pins, for example pins 10 illustrated in FIG. 5, are insertable.

Figure 5:
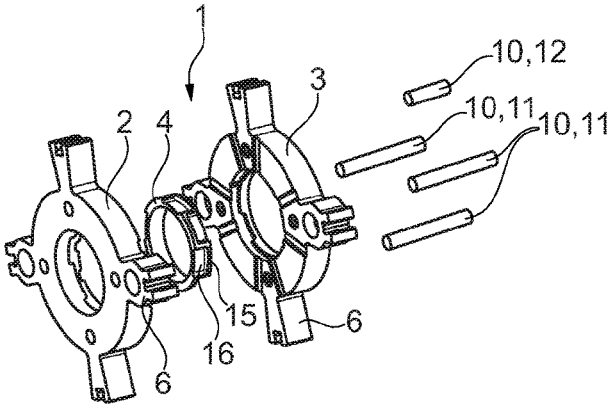
FIG. 5 shows a variant of another multipart rotor in an exploded view.

With reference to FIG. 5, pins 10 are designed either as spring suspension pins 11, or as short pins 12 which are used solely for the connection. It has proven to be particularly advantageous to use three spring suspension pins 11 together with one short pin 12, short pin 12 having only 40% to 80% of the length of the spring suspension pin, but in any case being shorter than the width of rotor 1 measured in the axial direction.

Returning to FIG. 2, second rotor secondary body 4, designed as an oil-conducting ring 13, is secured to rotor main body 2 and/or to first rotor secondary body 3 via a press fit, namely, a longitudinal press fit.

The radially outer side of oil-conducting ring 13 has a wave-shaped outer contour, whereby the waves may also have an angular design such that oil-conducting pockets 14 are defined by radially protruding ribs 15. Oil-conducting pockets 14, viewed across the circumference, are open in alternation at the top or the bottom, i.e., are open in one axial direction or the other. The oil-conducting pockets are provided for conducting a hydraulic medium such as oil to hydraulic medium-conducting channels 5, all hydraulic medium-conducting channels 5 being situated in the same separating plane between rotor main body 2 and first rotor secondary body 3. The separating plane is referred to as a transversal plane, and is perpendicular to the center axis, which is oriented in the axial direction.

It is possible for rotor main body 2 or first rotor secondary body 3 to have integral projections or recesses which engage in a form-fit and/or force-fit manner with corresponding counter contours of the other component adjoining the end face. This may be used in addition to or as an alternative to the pinning.

Weldings, in particular laser weldings, may be dispensed with in particular when oil-conducting ring 13 is inserted into the interior of rotor main body 2 and of first rotor secondary body 3 by forced cold forming.

Figure 3:
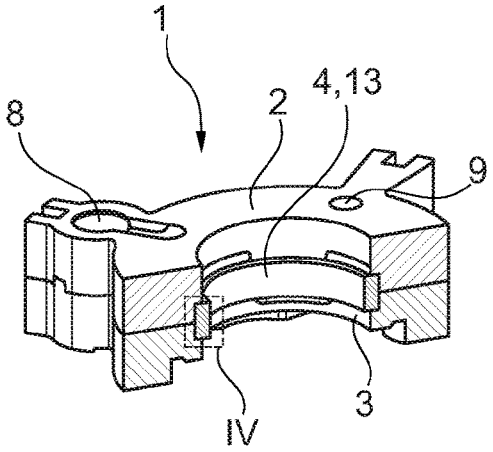
FIG. 3 shows a cutaway view of rotor 1 depicted in a perspective view in FIG. 1.
Figure 4:
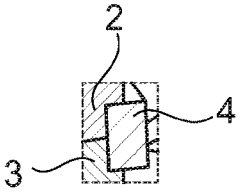
FIG. 4 shows an enlargement of area IV from FIG. 3 together with the second rotor secondary body present there.

FIGS. 3 and 4 illustrate the pressed-in state of oil-conducting ring 13 into the components, namely, rotor main body 2 and first rotor secondary body 3, which form the two rotor halves. A caulking or multiple mutually separated caulkings may also be present between these three individual components.

Figure 6:
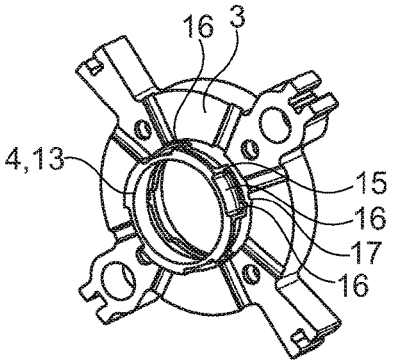
FIG. 6 shows an isolated illustration of the second rotor secondary body adjacent to one of the following components: rotor main body and first rotor secondary body.
Figure 7:
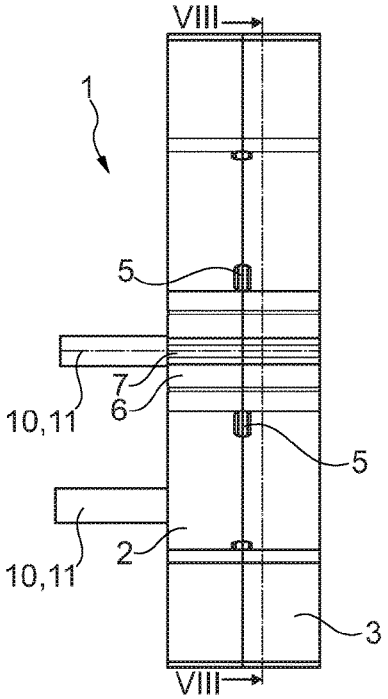
FIG. 7 shows a side view of the rotor from FIG. 5.
Figure 8:
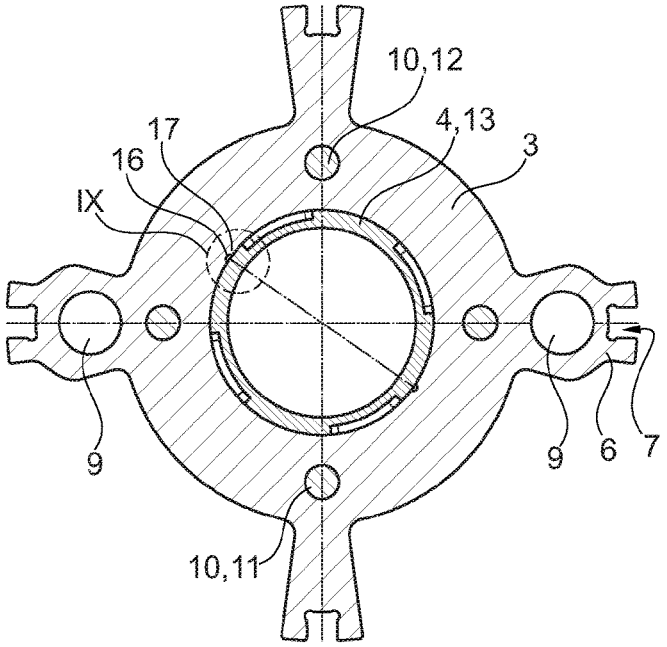
FIG. 8 shows a cross section of the rotor from FIG. 7 along line VIII.
Figure 9:
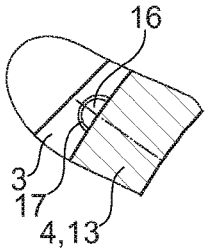
FIG. 9 shows an enlargement of area IX from FIG. 8.
Figure 10:
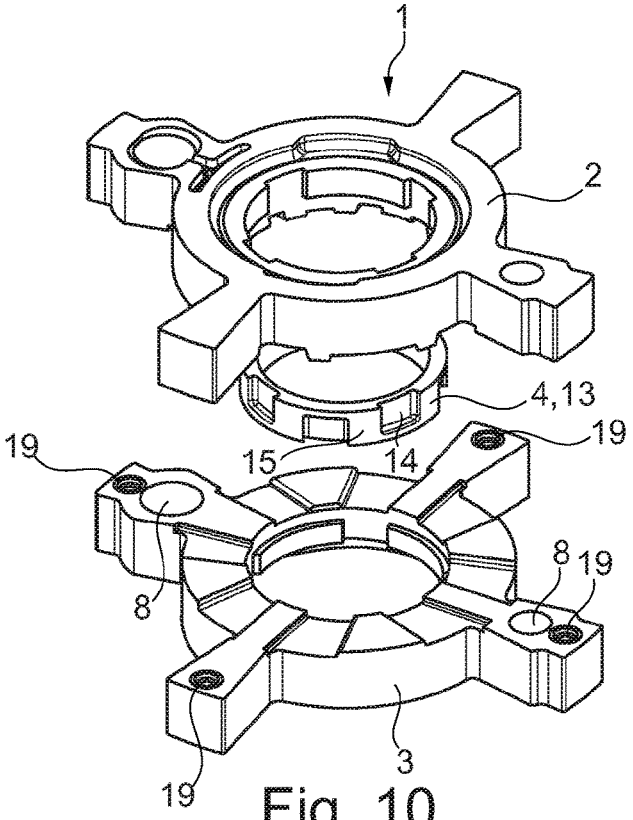
FIG. 10 shows a variant of a rotor in an exploded view from below.
Figure 11:
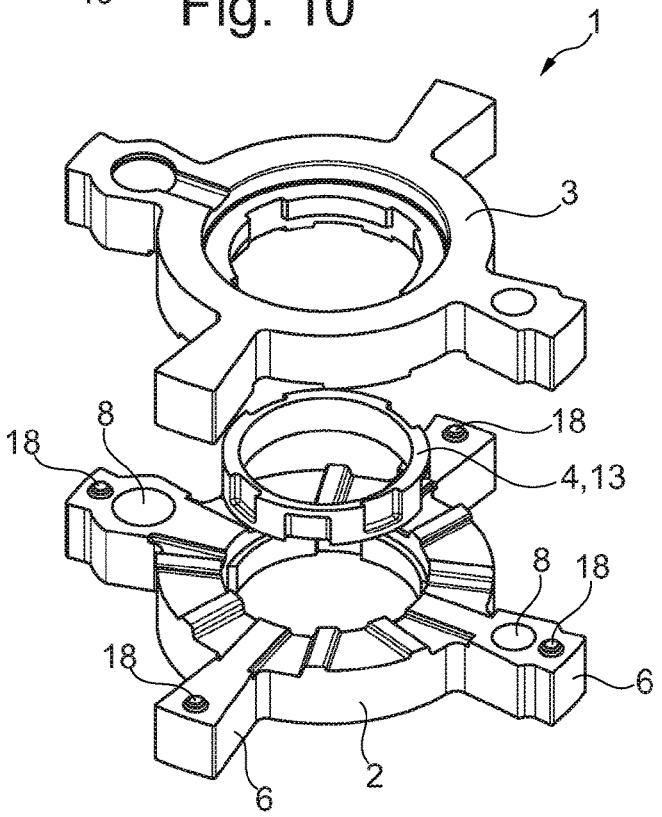
FIG. 11 shows the rotor from FIG. 10 in an exploded view.

While FIG. 5 illustrates the overall assembly of rotor 1 with the addition of three spring suspension pins 11 and one short pin 12, FIG. 6 illustrates only the connection of second rotor secondary body 4 to first rotor secondary body 3. Rotor main body 2 is not illustrated here, but may also be present or added at the location of first rotor secondary body 3. As also indicated in FIGS. 8 and 9, oil-conducting ring 13 includes anti-twist sections 16 which engage with corresponding anti-twist counter sections 17. The section plane for the illustration in FIGS. 8 and 9 is denoted in FIG. 7.

The two anti-twist sections 16 are provided opposite one another on the outer sides of oil-conducting ring 13, i.e., are offset by 180° with respect to one another.

Figure 12:
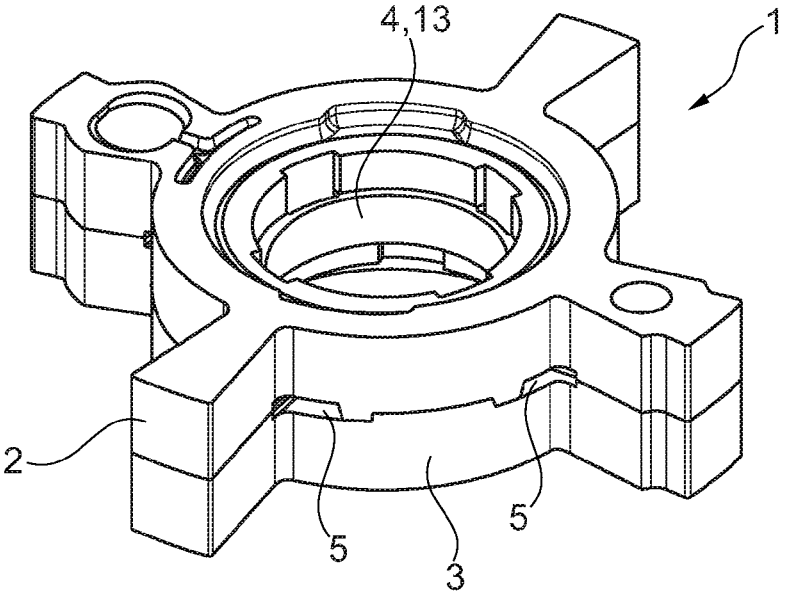
FIG. 12 shows a perspective view of the assembly of the rotor in FIGS. 10 and 11 in a view from below.
Figure 13:
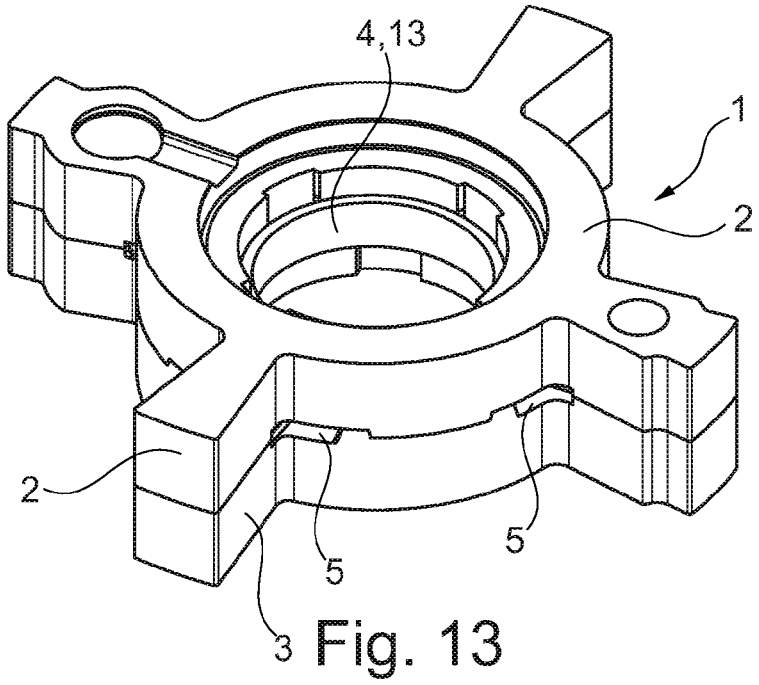
FIG. 13 shows the assembled rotor from FIG. 11 in a perspective view from above.

FIGS. 10 through 13 illustrate a refined version of a rotor 1, in this case journals 18 additionally being present, radially outside holes 8 from vanes 6, which engage with vanes 6 of the other component in corresponding receiving holes 19 in the manner of blind holes, thus achieving the assembled state illustrated in FIGS. 12 and 13.

In the exemplary embodiment in FIGS. 10 through 13, pinning which uses separate pins 10 is dispensed with, since journals 18 are integral parts either of rotor main body 2 or of rotor secondary body 3, so that receiving holes 19 are present either in first rotor secondary body 3 or in rotor main body 2.

LIST OF REFERENCE NUMERALS

1 rotor
2 rotor main body
3 first rotor secondary body
4 second rotor secondary body
5 hydraulic medium-conducting channel
6 vane
7 groove
8 hole
9 fixing hole
10 pin
11 spring suspension pin
12 short pin
13 oil-conducting ring
14 oil-conducting pocket
15 rib
16 anti-twist section
17 anti-twist counter section
18 journal
19 receiving hole

What is claimed is:

1. A multipart rotor for a hydraulic camshaft adjuster, the multipart rotor comprising:

a rotor main body connected to a first rotor secondary body in a rotatably fixed and axially fixed manner, the rotor main body and the first rotor secondary body together forming at least one hydraulic medium-conducting channel, and a ring-shaped second rotor secondary body being situated concentrically with respect to the rotor main body and the first rotor secondary body on a radially inner side of the rotor main body and the first rotor secondary body, the second rotor secondary body being secured to the rotor main body or to the first rotor secondary body in an axially fixed and rotatably fixed manner.

2. The rotor as recited in claim 1 wherein the axially fixed and rotatably fixed manner is achieved via a press fit or caulking.

3. The rotor as recited in claim 1 wherein the axially fixed and rotatably fixed manner is achieved via a longitudinal press fit.

4. The rotor as recited in claim 1 wherein the second rotor secondary body is designed as an oil-conducting ring conducting oil supplied axially from first and second sides of the oil-conducting ring to first and second hydraulic medium-conducting channels of the at least one hydraulic medium-conducting channel, oil from the first side of the oil-conducting ring being supplied only to the first hydraulic medium-conducting channel, and oil from the second side of the oil-conducting ring being supplied only to the second hydraulic medium-conducting channel.

5. The rotor as recited in claim 4 wherein the first hydraulic medium-conducting channel and the second hydraulic medium-conducting channel are for filling first and second working chambers of a vane cell extending in a shared separating plane oriented perpendicularly with respect to an axial direction and defined by abutment of end faces of the rotor main body and of the first rotor secondary body.

6. The rotor as recited in claim 4 wherein the oil-conducting ring includes oil-conducting pockets open in opposite directions.

7. The rotor as recited in claim 1 wherein at least one member of a group consisting of the rotor main body, the first rotor secondary body, and the second rotor secondary body is made of a different material or is made of a same material and has different densities, hardnesses, or porosities than another member of the group.

8. The rotor as recited in claim 7 wherein the one member is made of a metallic or ceramic sintered material and the other member is made of a plastic, a steel alloy, or a light alloy pure or permeated with sintered material.

9. The rotor as recited in claim 1 wherein at least two members of a group consisting of the rotor main body, the first rotor secondary body, and the second rotor secondary body are pinned together.

10. The rotor as recited in claim 1 wherein the rotor main body or the first rotor secondary body has integral projections and recesses engaging with one another in a form-fit or force-fit manner.

11. The rotor as recited in claim 1 wherein the second rotor secondary body includes an anti-twist section cooperating with a corresponding anti-twist counter section for preventing twisting of the second rotor secondary body relative to the rotor main body or the first rotor secondary body.

* * * * *